US008549683B2

(12) United States Patent
Ratner

(10) Patent No.: US 8,549,683 B2
(45) Date of Patent: Oct. 8, 2013

(54) SURGICAL HEAD SUPPORT

(75) Inventor: Jeffrey Bruce Ratner, Pinellas Park, FL (US)

(73) Assignee: Mercury Enterprises, Inc., Clearwater, FL (US)

( * ) Notice: Subject to any disclaimer, the term of this patent is extended or adjusted under 35 U.S.C. 154(b) by 22 days.

(21) Appl. No.: 13/385,271

(22) Filed: Feb. 10, 2012

(65) Prior Publication Data

US 2013/0205504 A1 Aug. 15, 2013

(51) Int. Cl.
*A61G 13/12* (2006.01)
*A61G 7/07* (2006.01)

(52) U.S. Cl.
USPC ..... 5/638; 5/637; 5/640; 5/622; 128/845

(58) Field of Classification Search
USPC ..... 5/622, 636–640, 643, 657, 409, 410, 5/411, 280, 723; 128/845
See application file for complete search history.

(56) References Cited

U.S. PATENT DOCUMENTS

| | | | | |
|---|---|---|---|---|
| 1,194,200 | A * | 8/1916 | Lowder | 5/643 |
| 3,140,497 | A * | 7/1964 | Carswell | 5/638 |
| 3,337,883 | A | 8/1967 | Allison | |
| 3,694,831 | A * | 10/1972 | Treace | 5/638 |
| 4,752,064 | A | 6/1988 | Voss | |
| 4,757,983 | A | 7/1988 | Ray et al. | |
| 5,269,035 | A | 12/1993 | Hartunian | |
| 5,347,668 | A * | 9/1994 | Manning | 5/622 |
| 5,520,623 | A | 5/1996 | Williams | |
| 5,613,501 | A | 3/1997 | Michelson | |
| 5,960,494 | A | 10/1999 | Gilliland et al. | |
| 6,112,333 | A | 9/2000 | Mazzei | |
| 6,345,401 | B1 * | 2/2002 | Frydman | 5/636 |
| 6,427,272 | B1 | 8/2002 | Yacoub | |
| 6,490,737 | B1 * | 12/2002 | Mazzei et al. | 2/410 |
| 6,523,202 | B2 | 2/2003 | Loomos | |
| 6,637,058 | B1 | 10/2003 | Lamb | |
| 6,842,924 | B1 | 1/2005 | Walters | |
| 7,424,759 | B2 * | 9/2008 | Damron | 5/641 |
| 7,426,763 | B2 | 9/2008 | Mazzei et al. | |
| 8,234,731 | B2 * | 8/2012 | Skripps | 5/622 |

* cited by examiner

*Primary Examiner* — Michael Trettel
(74) *Attorney, Agent, or Firm* — Larson & Larson, P.A.; Frank Liebenow; Justin P. Miller

(57) ABSTRACT

A cushioned head support device for safely and comfortably supporting a patient's head during procedures where the patient is positioned face down. The device affords easy access to the patient's face, providing multiple suitable openings for inserting medical devices as well as for viewing the patient. A mirror is provided so that medical personnel may view the patient's face conveniently and easily while working above the patient. The device is readily adjustable in multiple dimensions, providing for adjustment to accommodate any size face or head, as well as adjustments to raise or lower the height of the device or to tilt the device in any direction. The invention further comprises disposable cushions in various sizes to accommodate children as well as adults.

20 Claims, 9 Drawing Sheets

SURGICAL HEAD SUPPORT

BACKGROUND OF THE INVENTION (1) Field of Invention

The present invention relates to the field of head support devices, more particularly head support devices for use in procedures where the patient is positioned face down.

(2) Description of Prior Art

Head and face support and protection devices for use during operations where a patient is positioned face down for any length of time are well known in the art. It is well established that a patient's external and internal face structures could be injured during face down operations if the head and face are not supported in a proper manner. In addition to the obvious need to support the face and head in a way that allows the patient to breathe freely and also provide technicians access to the face, there is also a need to support the face structures in such a manner that the pressure between the face and the support structure does not cause injury to the patient during a potentially lengthy procedure, due to gravity and other forces applied to the patient during the procedure. Numerous devices have been disclosed which are designed to support a patient's head and face safely and comfortably during face down procedures. These devices generally comprise padded or foam structures with openings for breathing as well as accessing and viewing the patient during a face down procedure.

Many of the devices designed for this purpose are made simply of foam with no further support materials, and are designed to be placed on top of an operating table. U.S. Pat. No. 5,269,035, U.S. Pat. No. 5,613,501, U.S. Pat. No. 6,427,272, U.S. Pat. No. 6,637,058 B1, and U.S. Pat. No. 6,842,924 B1, each disclose contoured foam support pillows of varying design. U.S. Pat. No. 5,269,035 discloses a block-like contoured foam support with openings for breathing, viewing, medical instruments, tubes, etc. U.S. Pat. No. 5,613,501 discloses a contoured foam support with a convex underside designed to flex and create an evenly distributed force against the patient's face. U.S. Pat. No. 6,427,272 discloses a foam "anesthesia pillow" which is a contoured foam pillow with multiple access channels. U.S. Pat. No. 6,637,058 B1 discloses a surgical pillow comprising 2 different types of foam with face cutout and access channels. And U.S. Pat. No. 6,842,924 B1 discloses a contoured foam support with cutout and access channels.

A number of other support devices utilize a foam pillow of some type mounted on some type of solid support, these devices being designed to sit on top of or attach to an operating table. U.S. Pat. No. 4,752,064, U.S. Pat. No. 4,757,983, and U.S. Pat. No. 7,426,763 B2 each disclose inventions of this type. U.S. Pat. No. 4,752,064 discloses a device comprising a pillow made of soft resilient foam which is contoured to the shape of the face with a T-shaped cutout section, sitting upon a support plate with an attached tilt-adjustable mirror hanging below, and a clamp for attaching the apparatus to the end of a table. U.S. Pat. No. 4,757,983 discloses devices with rocker or pivot bases with contoured chin support and forehead support cushions resting upon them. The devices provides for adjustment of the distance between the chin and forehead support cushions and angle of tilt of the head in one plane, allowing for lowering or raising the chin in relation to the forehead. And U.S. Pat. No. 7,426,763 B2 discloses a device with a single contoured cushion set on a base with independently adjustable shock absorbing support pins, which may be used in conjunction with a mirror and/or with struts extending from the end of an operating table.

And a third grouping of previously disclosed devices have a padded solid frame. U.S. Pat. No. 3,337,883, U.S. Pat. No. 5,520,623, and U.S. Pat. No. 6,112,333 each disclose inventions of this type. U.S. Pat. No. 3,337,883 discloses a padded trough-like structure with an opening for the eyes, nose and mouth. U.S. Pat. No. 5,520,623 discloses a device with a cushioned open frame and a rigid convex open mesh. The device also features a transversely extending height-adjustable base which underlies the patient's chest and stabilizes the device. U.S. Pat. No. 6,112,333 discloses protective helmet with padded interior and modular components.

Yet another example of prior art is U.S. Pat. No. 5,960,494 which discloses a support mask with independently inflatable cushions, which are electronically inflated and deflated at specific time intervals.

SUMMARY OF THE INVENTION

The applicant has discovered numerous disadvantages to previously disclosed inventions. A primary problem with many prior art devices is the lack of ease and/or imprecision of adjustability of the device, especially while the device is in use with a patient's weight upon it. Another major problem with many of the prior art devices is the need to disconnect the breathing circuit in order to engage the head support. Further, many prior art devices have extremely limited visibility and access to the patient's face. Where use of a mirror is suggested, there is often no means provided for properly positioning the mirror or to keep it stably in position throughout the procedure.

Beyond this, many of the prior art devices afford themselves to various problems with the foam cushioning. Where devices use a separate chin and forehead support foam, there may be danger of confusing the two different types of cushions and inadvertently interchanging them. Some of the devices do not allow for replacement of included foam cushions at all, thus leading to hygiene and expense issues. And where cushion replacement is possible it may be inconvenient. Some all-foam devices require a firm foam type for support and therefore are not as soft at contact points as would be preferable. And in some devices, the cushioning or padding is simply inadequate, allowing the patient's face to come in contact with hard edges during use and causing undesirable results. In addition some of the all-foam devices are particularly mechanically unstable.

The present invention solves all of these problems. Applicant's device provides a stable, safe, easily and precisely adjustable head support which can lengthen to accommodate any length head, can be readily raised or lowered or tilted in any desired direction, all using convenient adjustment screws. In particular, it allows ready adjustment of the device while the patient's head is resting upon it. The device affords excellent viewing of the patient both directly and via means of the provided mirror, which is easily positioned and stabilized in position via depressions at the corners of the mirror. Further, the present surgical head support provides large access spaces for medical instruments, tubing, etc. and most importantly, engagement of the device does not require disconnection of the breathing circuit. The cushion-over-fin design ensures that no hard surfaces are exposed to contact with the patient's body and that the cushions are stable and soft while in use, yet easily removed and replaced when not in use. The cushions come in multiple sizes to accommodate all head sizes, both children and adults, and the forehead and chin cushions cannot be interchanged with one another, thereby avoiding accidental misuse of the device.

REFERENCE NUMERALS IN DRAWINGS

Figure 1:
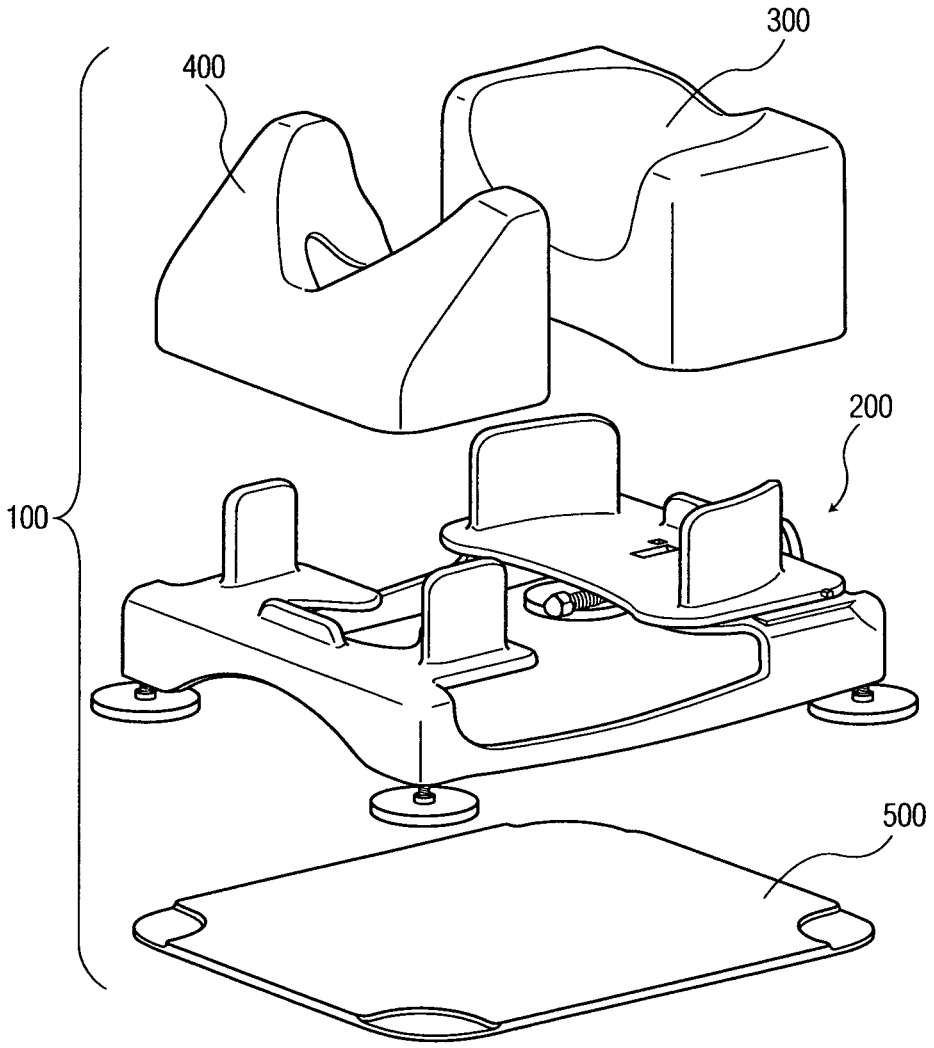
FIG. 1 shows an exploded view of an example of a head support device according to the present invention.

100 An example of a head support device according to the present invention.
200 An example of a base
202 An example of a frame
204 Chin support
206 Side fin on chin support
208 Center fin on chin support
210 Oral cutout on chin support
212 An example of a forehead support
214 Curved side fins on forehead support
216 Center fin on forehead support
218 Cutout on forehead support
220 Adjustment screw loops on underside of forehead support
222 Forehead support adjustment screw
224 Knob of forehead support adjustment screw
226 Threaded shaft of forehead support adjustment screw
228 Adjustment screw hole in frame
230 Fixed collar
232 Moveable collar
234 Endcap
236 Threaded leg
238 Foot
240 Edge of Foot
242 Bottom of foot
244 Retaining collar
246 Nut
248 Screw retaining cap
250 Leg receiving hole
300 An example of a forehead support cushion
302 Forehead contour/cavity
304 Flat underside of forehead support cushion
306 Side fin slot on underside of forehead support cushion
308 Center fin slot on underside of forehead support cushion
400 An example of a chin support cushion
402 Chin/neck contour of chin support cushion
404 Oral cavity of chin support cushion
406 Flat underside of chin support cushion
408 Side fin slot on underside of chin support cushion
410 Center fin slot on underside of chin support cushion
500 An example of a mirror
502 Depressions at corners of mirror

DETAILED DESCRIPTION OF THE INVENTION

General Description

The present invention is a head support device for use during face down procedures. The invention comprises a base and contoured foam cushions, said base comprising a frame exhibiting facial support areas with fins, and said contoured foam cushions designed to fit snugly over these fins so as to provide a safe, comfortable and stable resting surface for the face and head during extended face down procedures, such as surgical operations and the like. The open design of the device allows a great deal of access space for medical instruments, viewing, breathing, etc. while still providing stable, comfortable and safe support of the face and head for prolonged periods.

The cushions removably engage with the fins, allowing for ready removal, disposal, and replacement of soiled cushions as well as interchange of cushions of different sizes to accommodate different size heads. A preferred embodiment of the present invention utilizes 2 cushions; a forehead support cushion and a chin support cushion. It is also preferable that the fin patterns for, and fin-receiving slots of, the chin support cushion differ from those of the forehead support cushion, thus preventing accidental interchange of forehead and chin cushions during use.

A preferred embodiment has a substantially rectangular frame and 4 independently adjustable threaded legs, providing a stable table-like support surface which can be raised or lowered or adjusted to tilt in any desired direction and set stably in that position. Further, a preferred embodiment provides a forehead support that is slidably attached to the base such that the distance between the forehead support cushion and the chin support cushion can be readily adjusted by sliding the forehead support. A preferred embodiment also includes an adjustment screw to easily and stably adjust the distance between the forehead support cushion and the chin support cushion. Alternative embodiments of the invention might incorporate a slidable chin support either in conjunction with, or as an alternative to, the presently illustrated slidable forehead support.

A mirror is provided for easy viewing of the patient's face from areas above the patient's body. A preferred mirror has concave depressions at the corners so as to provide seats for the feet of the base portion of the device, thus allowing easy, stable, correct positioning of the mirror underneath the support device.

Specific Embodiments of the Invention

Referring to FIG. 1, one embodiment (100) of the present invention is shown. The base (200) sits atop mirror (500) and supports forehead support cushion (300) and chin support cushion (400).

Figure 2A:
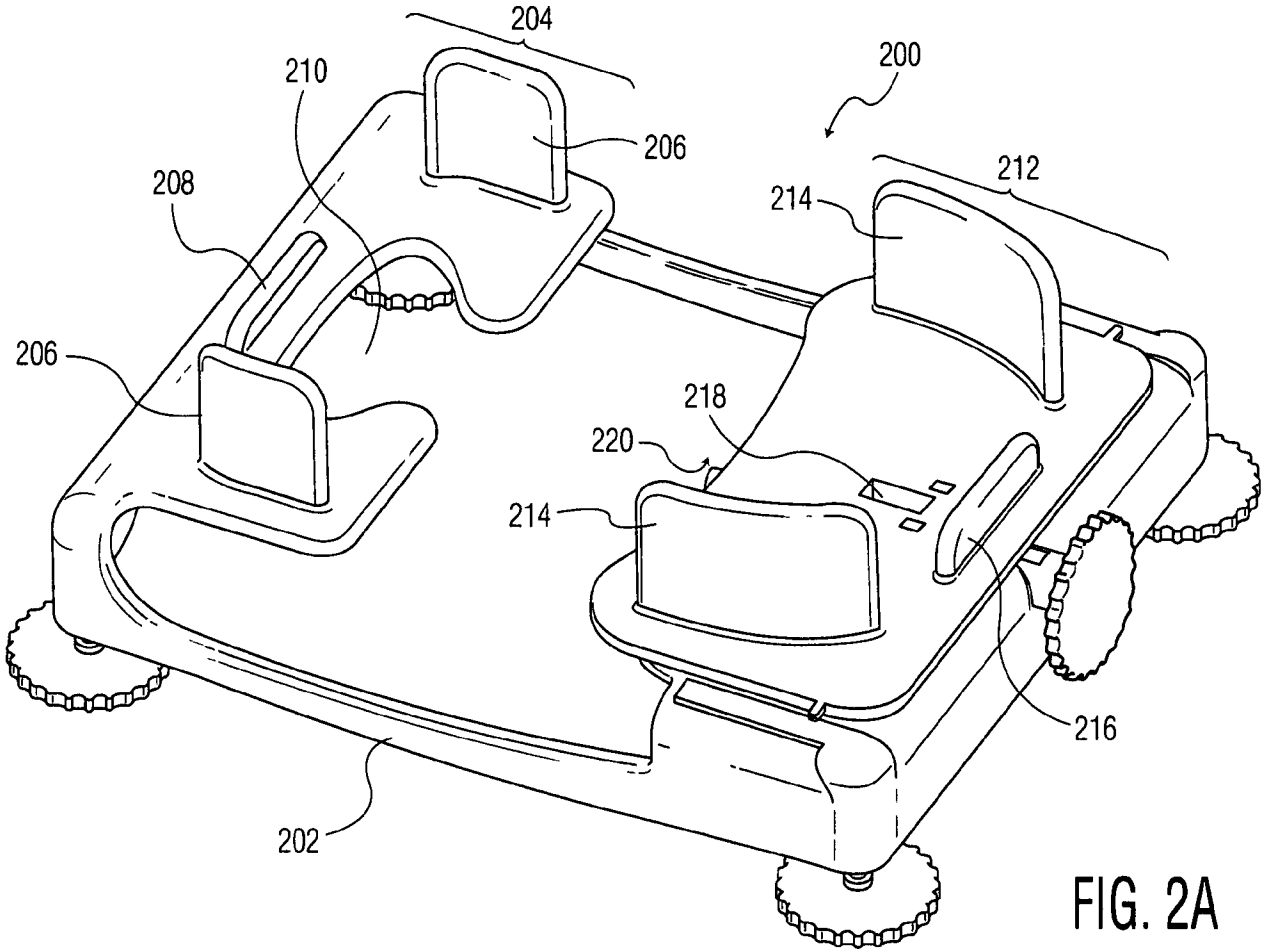
FIG. 2A shows an angled top view of an example of a base portion of a head support device according to the present invention.

Referring to FIG. 2A, an example of a base (200) for an embodiment of the present invention (100) is shown. The frame (202) is substantially rectangular, having a chin support (204) at one end. The chin support (204) has 2 curved side fins (206) and a shorter center fin (208), all projecting upward. The chin support (204) also is contoured to allow for breathing and access to the oral cavity and thus exhibits an oral cutout (210) at its center.

Figure 2B:
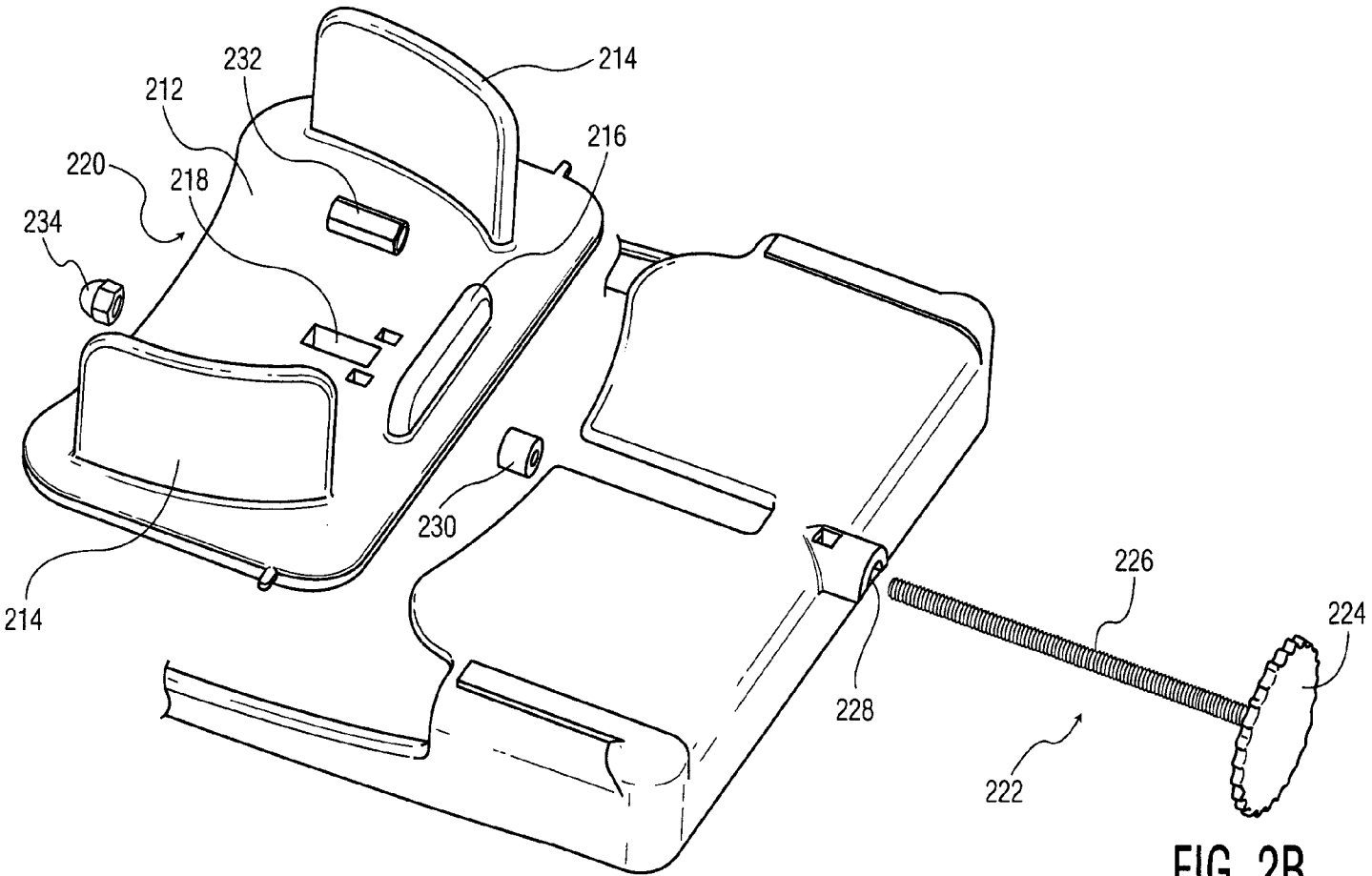
FIG. 2B shows an exploded view of an example of a forehead support mechanism from a head support device according to the present invention.
Figure 2C:
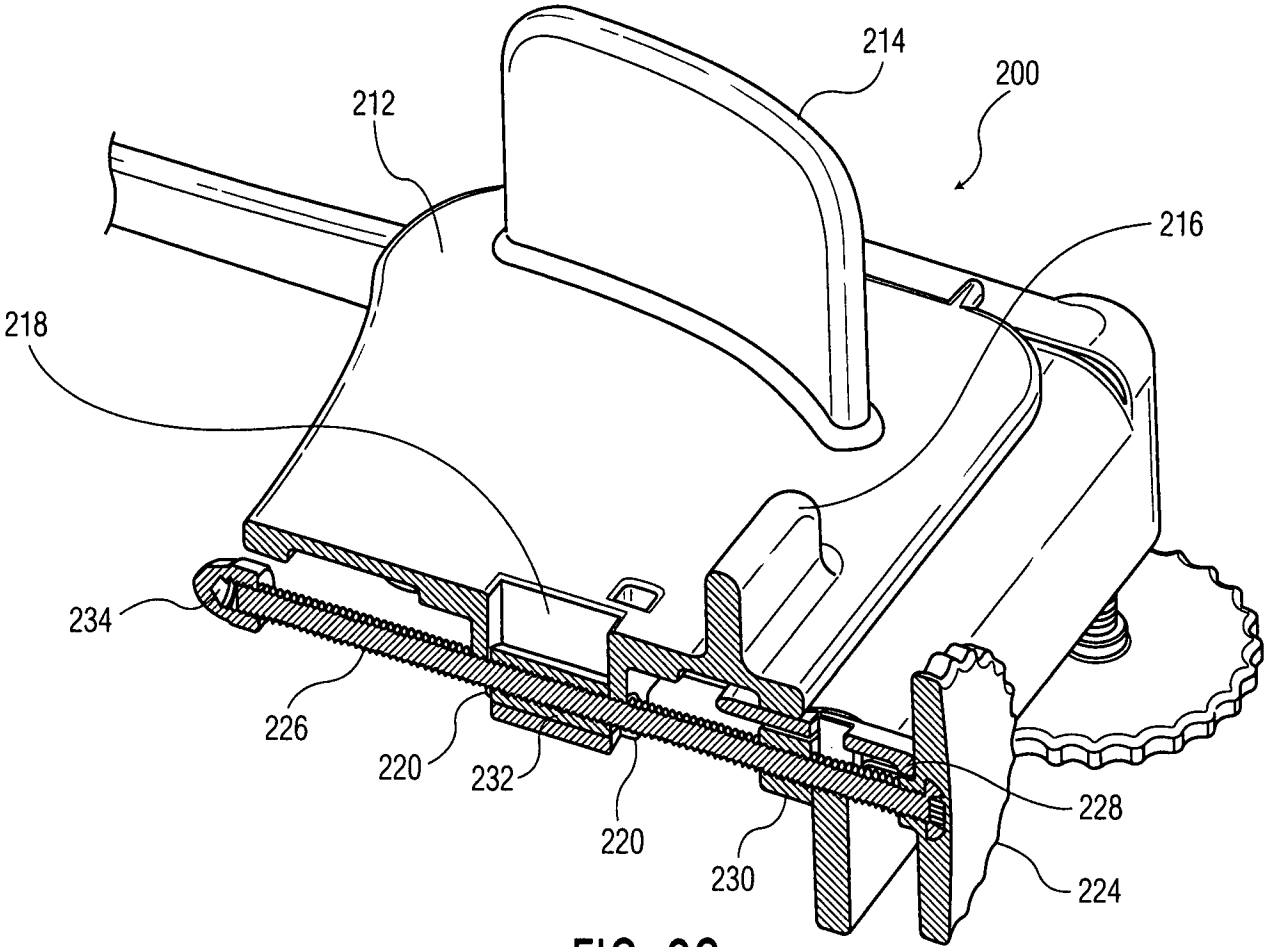
FIG. 2C shows a section view of an example of a forehead support mechanism from a head support device according to the present invention.

The frame (202) also has a forehead support (212) slidably mounted at the end opposite the chin support (204). The forehead support (212) also provides 2 curved side fins (214) and a shorter center fin (216), all projecting upward. Referring to FIGS. 2B and 2C, an exploded view of an example of a forehead support adjustment mechanism and a sectional view of an example of an assembled forehead support mechanism, are shown respectively. There is a small cutout rectangle (218) at the center of the forehead support (212) and 2 adjustment screw loops (220) on the center underside of the forehead support (212). The threaded shaft (226) of the forehead support adjustment screw (222) passes through the adjustment screw hole (228) in the frame (202), then through fixed collar (230), then through the first adjustment screw loop (220), then through the moveable collar (232), then through the second adjustment screw loop (220), and finally into the endcap (234). Turning the forehead support adjustment screw knob (224) causes the forehead support (212) to slide relative to the frame (202), and thereby shortens or lengthens the distance between the forehead support (212) and the chin support (204). Whatever adjustments may be made using the forehead support adjustment screw (222) remain stably set until a further adjustment is made, due to the design and orientation of the adjustment mechanism.

Figure 2D:
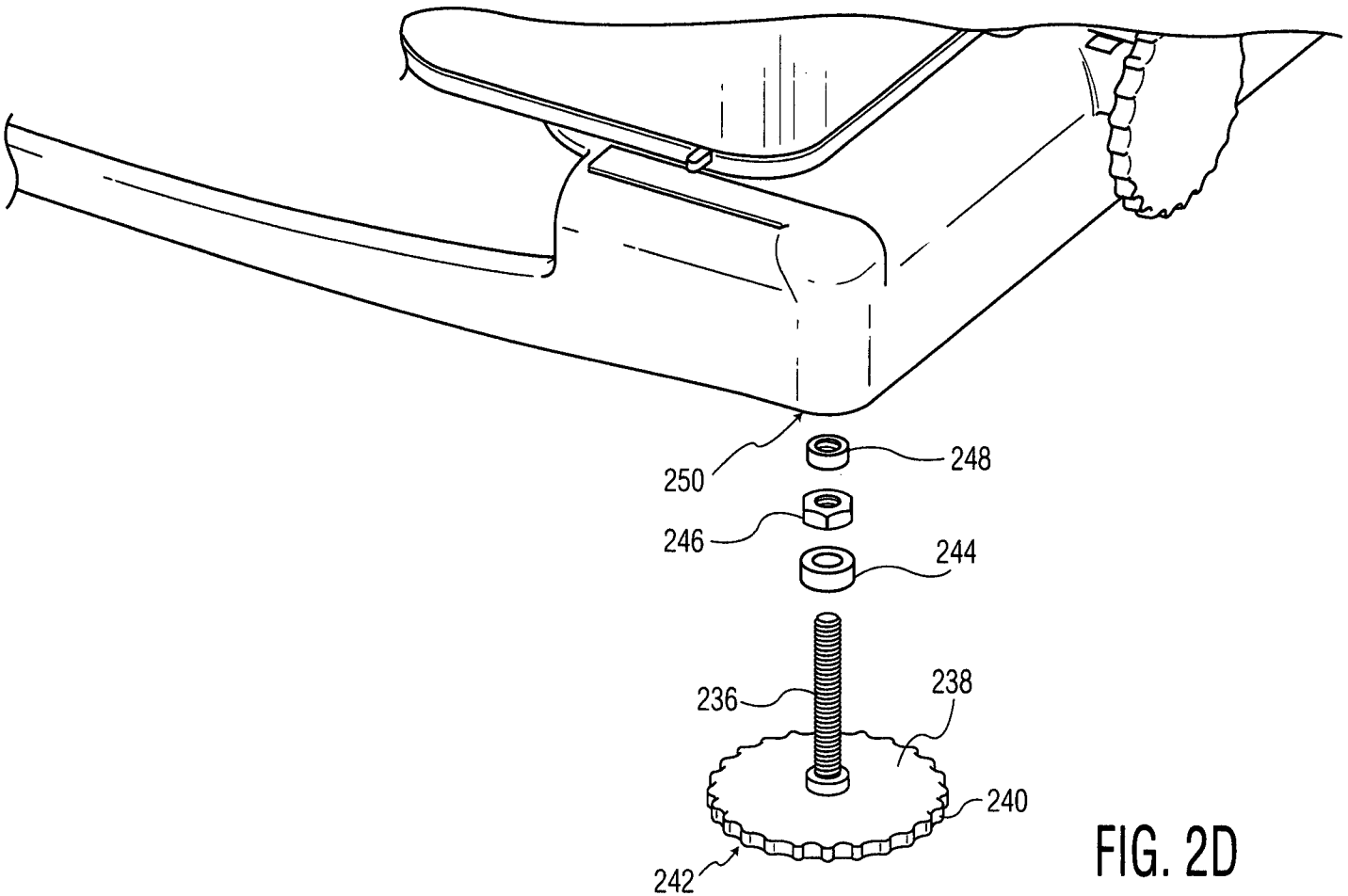
FIG. 2D shows an exploded view of an example of an adjustable leg mechanism from a head support device according to the present invention.

The base also has 4 threaded legs (236) supporting the frame (202) at the corners. Referring to FIG. 2D, an exploded leg adjustment mechanism is shown. In this example, for assembly, each threaded leg (236) is first insert-molded into a disc-shaped foot (238), having scalloped edges (240) and convex bottom (242). Then retaining collar (244) is slid down onto the threaded leg (236). Next, nut (246) is threaded well onto leg (236) and then screw retaining cap (248) is screwed onto and bonded to the very top of the screw. Each threaded leg (236) with retaining collar (244), nut (246) and screw retaining cap (248) is then engaged into a leg-receiving hole (250) on the underside of the frame (202) and the retaining collar (244) is then glued into the recess of leg-receiving hole (250) on the underside of the frame (202) to trap nut (246) in place. About 5 mm down into its bore, each leg-receiving hole (250) has a hex-shaped recess to receive nut (246). At the edge of its bore, leg-receiving hole (250) has a round recess to receive retaining collar (244). Once assembled, each leg may be independently shortened or lengthened by using the scalloped foot edges (240) as a knob to turn each leg (236) with respect to the frame (202). The device may thus be raised or lowered or tilted in any desired direction using the leg adjustment mechanisms.

Figure 3A:
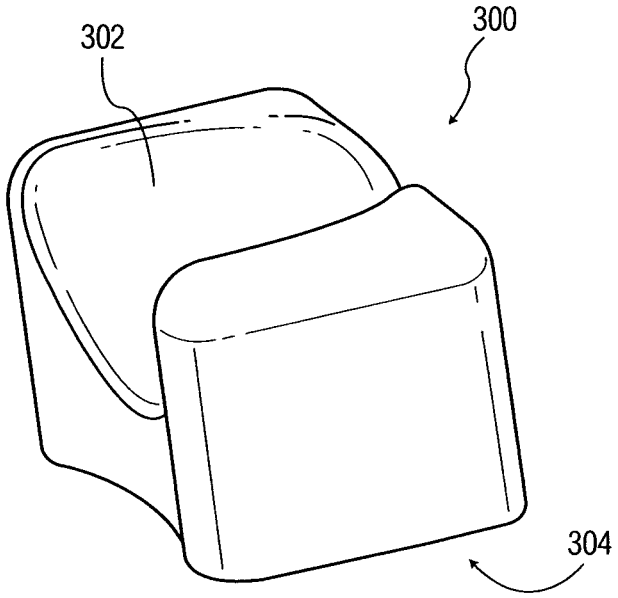
FIG. 3A shows a top angled view of an example of a forehead support cushion from a head support device according to the present invention.
Figure 3B:
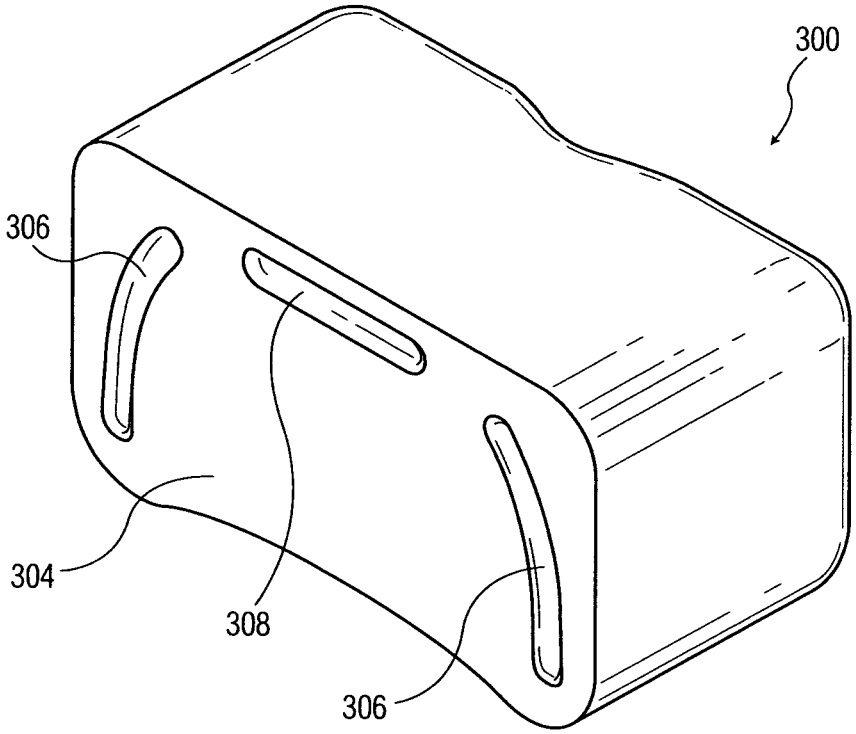
FIG. 3B shows bottom angled view of a forehead support cushion from a head support device according to the present invention.

Referring to FIGS. 3A and 3B, an example of a forehead support cushion (300) is shown. The upper surface of the forehead support cushion (300) has a rounded cavity or contour (302) to accommodate the forehead of a patient. The underside of the forehead support cushion (304) is flat except that it has 3 fin slots, 2 side fin slots (306) and 1 center fin slot (308). The forehead support cushion (300) fits over the forehead support (212), with the fin slots (306, 308) receiving the fins (214,216) from the forehead support.

Figure 4A:
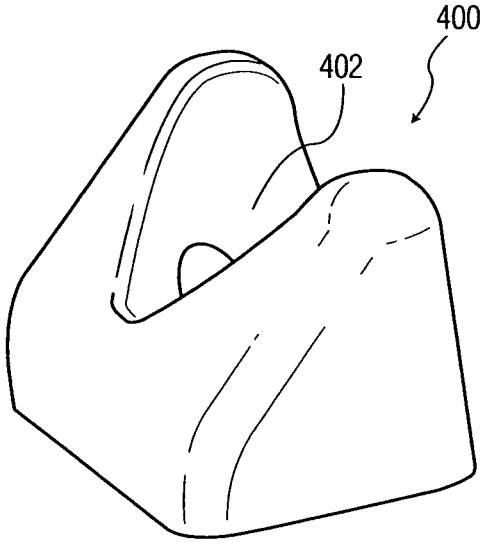
FIG. 4A shows a top angled view of a chin support cushion from a head support device according to the present invention.
Figure 4B:
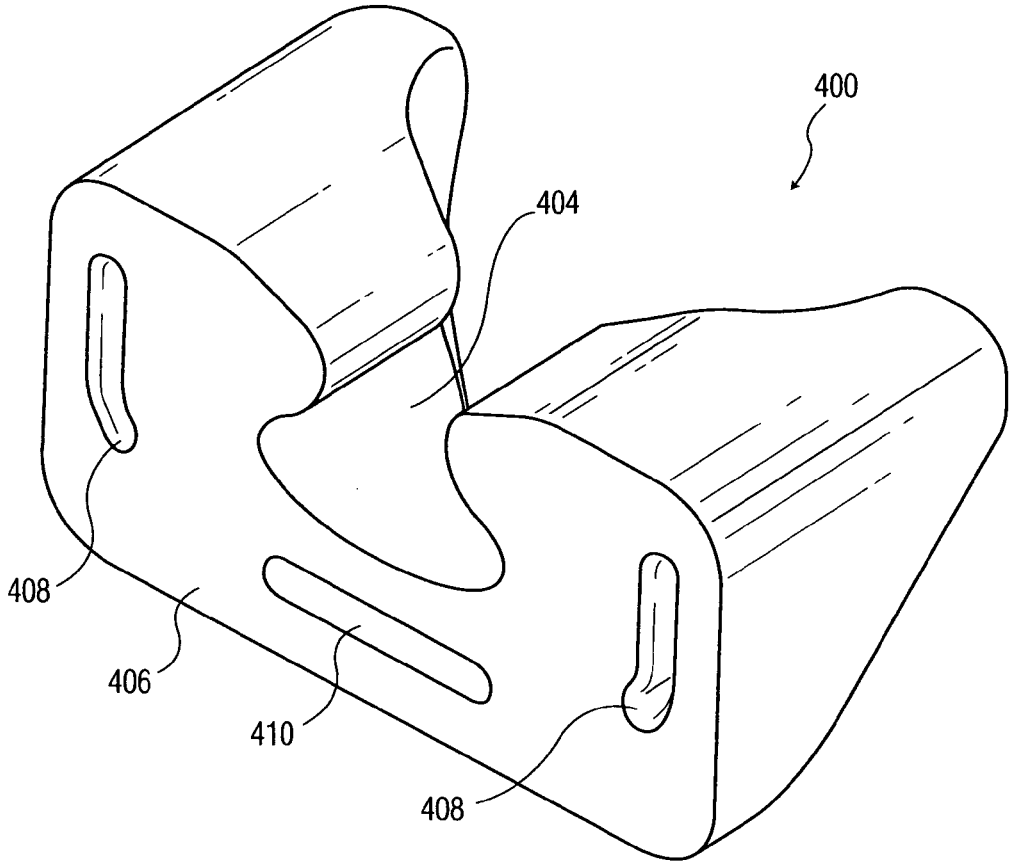
FIG. 4B shows a bottom angled view of a chin support cushion from a head support device according to the present invention.

Referring to FIGS. 4A and 4B, an example of a chin support cushion (400) is shown. The upper surface of the chin support cushion (400) has a shaped contour (402) to accommodate the neck and chin of a patient. An oral cavity cutout (404) leaves a large open space around the patient's mouth for breathing, medical attention and instruments. The underside of the chin support cushion (406) is flat except that it has 3 fin slots, 2 side fin slots (408) and 1 center fin slot (410). The chin support cushion (400) fits over the chin support (204), with the fin slots (408,410) receiving the fins (206, 208) from the chin support.

Figure 5:
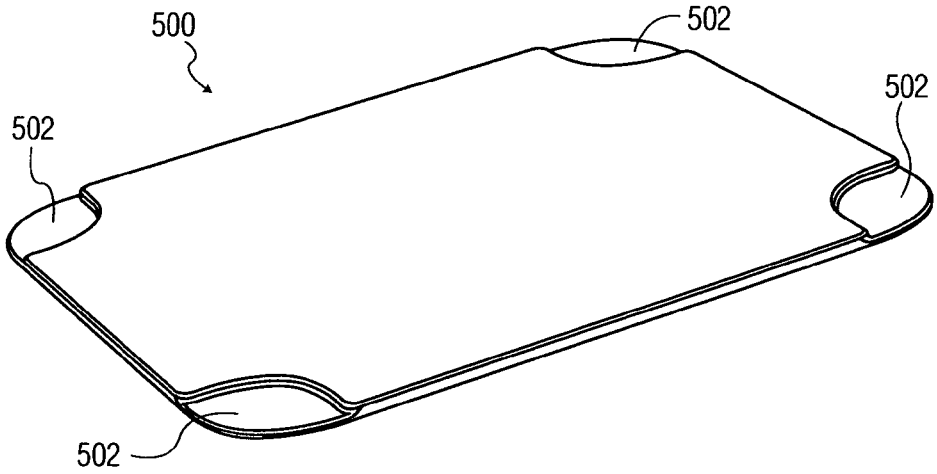
FIG. 5 shows a top angled view of an example of a mirror from a head support device according to the present invention.

Referring to FIG. 5, an example of a mirror (500) is shown. The mirror (500) sits directly beneath the base (200), allowing medical personnel to view the face of the patient, without the need to bend down and stop working, etc. The mirror (500) has depressions (502) at its corners such that the convex bottoms (242) of the feet (238) of the base (202) seat stably in them, making it easy to both position the mirror correctly and subsequently to keep it in position without effort.

Figure 6:
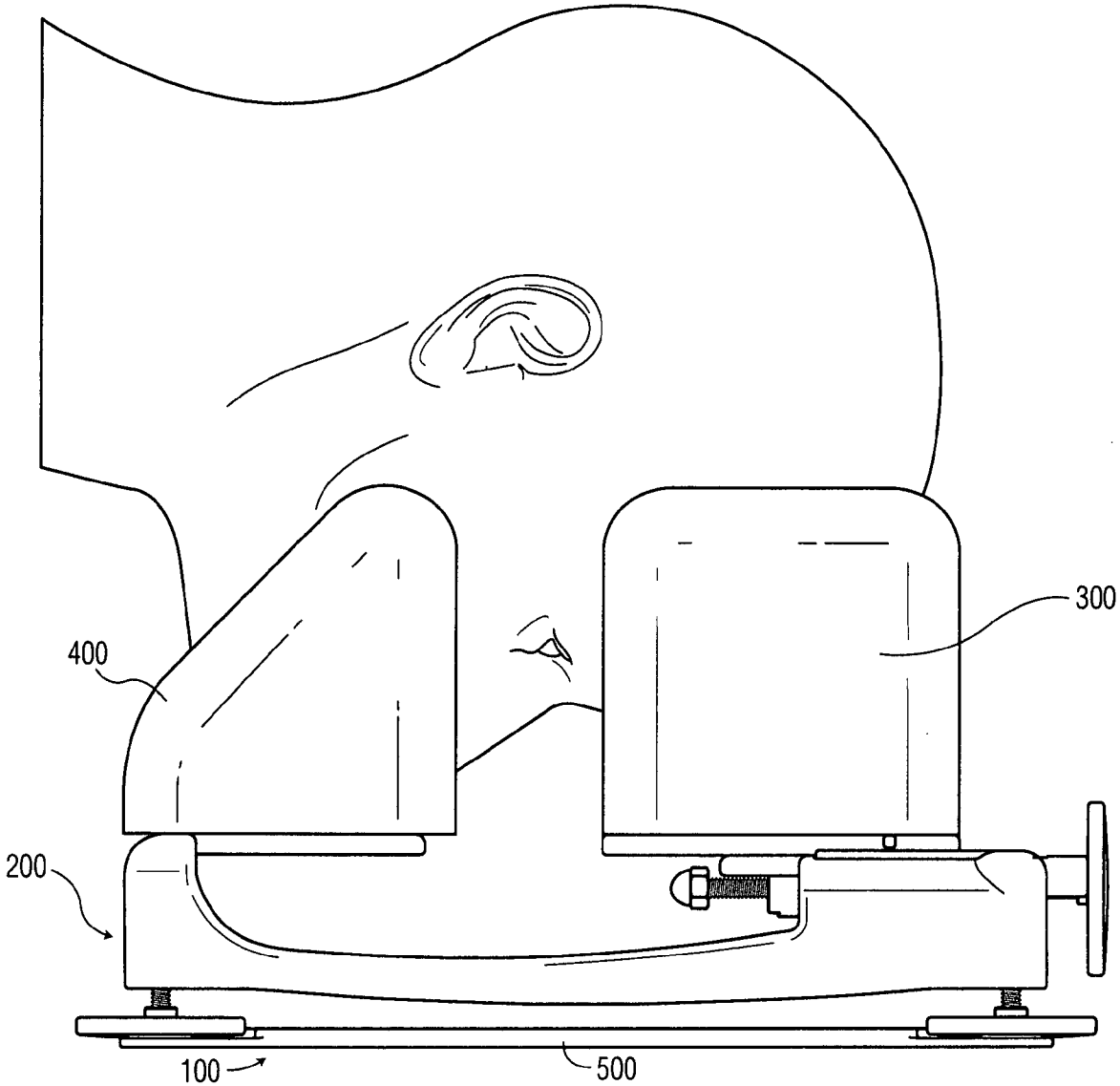
FIG. 6 shows a side view of a prone patient with head supported on an example of a head support device according to the present invention.

Referring to FIG. 6, a face down patient using the head support device (100) is shown. The patient's forehead is engaged with the forehead support cushion (300) and the patient's chin is engaged with the chin support cushion (400).

The cushions (300, 400) are preferably made of polyurethane foam which is inexpensive, disposable, soft, comfortable, pliant, and easy to mold into the desired shape. However, any suitable material, including but not limited to, all types of foam rubber, may be utilized.

The base (200) is preferably made of molded glass-reinforced polycarbonate plastic with stainless steel hardware. This type of polycarbonate plastic, having tiny glass fibers mixed in, is strong, stiff, impact resistant, easy to clean, easy to mold to the required shapes, available in any color, cheaper than machined metal parts, and offers a desirable cosmetic appearance. But any suitable material, including, but not limited to other plastics, may be used. Stainless steel hardware has the advantages of being substantially non-rusting, easy to clean, and strong, as well as presenting a desirable cosmetic appearance. But any suitable material may be used.

The mirror (500) is preferably fashioned from non-glass-reinforced polycarbonate which is strong, impact-resistant, easy to machine to the desired shape, and affords a desirable cosmetic appearance.

However, this is meant to be a non-limiting example and the present head support device may be fashioned from any suitable materials.

Operation:

The user of the head support (100) may choose from a range of cushion shapes and sizes depending upon the application. Once the device is assembled, ie. the chin support cushion (400) and forehead support cushion (300) are engaged upon their respective fins (206, 208, 214, 216), the patient may be placed face down onto the upright device (100). Or, alternatively, the device (100) may be placed onto the patient's face while the patient is supine (or in any other position) and the patient may then be turned over into the prone position with the device already engaged.

Because of the wide open design of the head support (100), there is ample visual and physical access to the patient's face, mouth, nose, eyes, etc. with the device engaged, and most importantly, there is no need to disconnect any extant breathing circuit in order to engage or disengage the head support.

Adjustments to the head support (100) may be made before engaging the device with the patient's face and/or while the device is in use. The length of each leg (236) may be independently adjusted in order to create a higher support, a lower support or a support which tilts in any desired direction. The threaded legs (236) hold their set length well and so the support will maintain any desired height or tilt once the legs are adjusted. The screw retaining cap (248) prevents the foot from unscrewing past the nut (246) and thereby stops the threaded leg (236) from unscrewing too far and becoming detached from the frame (202). Further, the legs (236) may be adjusted with the patient on the device by turning the feet (238) using the scalloped edges (240). The head support (100) may be lifted slightly to allow easy turning of the feet (238) to adjust the leg (236) lengths. Or the feet (238) may be turned while in position on the mirror (500). Thus the height and tilt of the head support (100) may be readily adjusted and readjusted at any desired point in a procedure.

The distance between the chin support (and cushion) (204, 400) and the forehead support (and cushion) (212, 300) may be shortened or lengthened by turning the knob (224) on the adjustment screw (222). This adjustment, together with a selection of chin (400) and forehead (300) support cushions allows the device (100) to accommodate any size head easily, comfortably and safely. Once again this adjustment may be made before engaging the device (100) with the patient's face or after, and in either the supine or prone position with the patient on the device. The prone patient may need to be lifted slightly to allow safe adjustment but the distance between the chin support (204, 400) and forehead support (212, 300) may also be adjusted and readjusted at any desired point in a procedure. Once again, the forehead support adjustment screw (222) holds its position well wherever set due to its design and the nature of the forces on the device.

The head support device (100) may be used with or without the mirror (500) provided. The convex foot bottoms (242) align readily with the depressions (502) at the 4 corners of the mirror (500) and the convex bottoms of the feet (242) maintain even contact with the mirror depressions (502) no matter what angle the head support surface is tilted with respect to the horizontal. The puzzle piece nature of the feet (242) and depressions (502) make it easy to position the mirror (500) correctly and also ensure that the mirror will maintain the correct position when placed. The mirror (500) may be placed in position either before or after the patient is engaged with the device (100) or while the patient is lying prone on the head support.

The result is a very stable and reliable, highly adjustable and safe head support (100) which affords a tremendous amount of visual and physical access to the patient. Ample space is provided for medical instruments, tubing, etc. as well as for assessing the patient's well-being and responding to care needs. The cushions (300, 400), once engaged with their respective fins (206, 208, 214, 216), hold their position well with no slippage and provide soft and safe, yet firm support with no exposure of the patient's face to any hard edges. Further, a softer foam can be used because of the excellent support provided by the fin structure (206, 208, 214, 216). The mirror (500) allows excellent visual assessment of the patient from above without the need for the medical technician to bend down to see the patient's face. And the mirror is both easily positioned and holds its position well because of the alignment of the bottoms of the 4 feet (242) with the 4 depressions (502) at the corners of the mirror (500). The height, length and tilt adjustments are all easily and conveniently made and hold firmly. The device (100) is economical and hygienic, allowing for simple and easy replacement or substitution of either chin (400) and/or forehead (300) cushions while preventing them (300, 400) from being unintentionally confused or interchanged with one another.

The examples given above are meant to be non-limiting examples of ways to practice the current invention. Many varied embodiments may be conceived which fall within the scope and spirit of the present invention. Although the above examples illustrate a specific shape base, fin designs, cushion shapes, leg adjustment mechanism and forehead support adjustment mechanism, many variations in the size and shape of the base, fins, and cushions as well as various different types of adjustment mechanisms are possible and may be used in practicing the current invention. For example, to provide the desired adjustability, a slidable chin support could be utilized either as an alternative to, or in conjunction with the illustrated slidable forehead support. The "frame" portion of the base, which supports the fins, need not be rectangular or a "closed loop". Other open or closed frame shapes might be successfully employed, such as oval or horseshoe for example, while still retaining the essence of the invention. Further, although successful embodiments of the present invention have been made using polyurethane foam, glass-reinforced and non-reinforced polycarbonate plastic, and stainless steel, any suitable materials may be used to construct the device. Likewise, the device may be made in any suitable size.

US PATENT REFERENCES

U.S. Pat. No. 3,337,883
U.S. Pat. No. 4,752,064
U.S. Pat. No. 4,757,983
U.S. Pat. No. 5,269,035
U.S. Pat. No. 5,520,623
U.S. Pat. No. 5,613,501
U.S. Pat. No. 5,960,494
U.S. Pat. No. 6,112,333
U.S. Pat. No. 6,427,272
U.S. Pat. No. 6,523,202
U.S. Pat. No. 6,637,058 B1
U.S. Pat. No. 6,842,924 B1
U.S. Pat. No. 7,426,763 B2

I claim:

1. A head support device for use during face down procedures comprising:

a base, said base comprising a frame having one or more fins, said head support device further comprising two cushions to support a patient's head, said cushions designed to removably engage with said one or more fins;

where said cushions comprise a first forehead support cushion designed to engage the patient's forehead and surrounding area and a second chin support cushion designed to engage a patient's chin and surrounding area.

2. The device of claim 1 where said base has independently adjustable legs.

3. The device of claim 2 where said legs are threaded such that each of said legs may be lengthened or shortened by rotating the leg in relation to said frame.

4. A head support device for use during face down procedures comprising:

a base, said base comprising a frame having one or more fins, said head support device further comprising one or more cushions to support a patient's head, said one or more cushions designed to removably engage with said one or more fins; and a support slidably attached to said frame, said slidably attached support having one or more fins.

5. The device of claim 4 where said slidably attached support is a forehead support.

6. The device of claim 4, further comprising a mirror.

7. The device of claim 4 where said cushions comprise a first forehead support cushion designed to engage the forehead and surrounding area of a patient's head and a second chin support cushion designed to engage a patient's chin and surrounding area.

8. The device of claim 7 further comprising an adjustment mechanism to adjust the distance between said chin support cushion and said forehead support cushion.

9. The device of claim 8 where said adjustment mechanism is a threaded adjustment screw.

10. The device of claim 1 further comprising a mirror.

11. The device of claim 10 where said mirror is made of plastic.

12. The device of claim 2, further comprising a mirror, where said mirror has depressions at its corners for seating the bottoms of said legs.

13. The device of claim 12 where said bottoms of said legs are convex.

14. The device of claim 1 where said chin support cushion is not interchangeable with said forehead support cushion.

15. The device of claim 1 where the fins designed to engage said forehead support cushion are different from the fins designed to engage said chin support cushion.

16. The device of claim 1 where said cushions are available in multiple sizes.

17. The device of claim 1 where said frame is substantially rectangular.

18. The device of claim 1 where said cushions are made substantially of foam rubber and said base is made substantially of plastic.

19. A head support device for use during face down procedures comprising:

a base, said base comprising a frame having one or more fins, said head support device further comprising one or more cushions to support a patient's head, said one or more cushions designed to removably engage with said one or more fins;

where said cushions comprise a first forehead support cushion designed to engage the patient's forehead and surrounding area and a second chin support cushion designed to engage a patient's chin and surrounding area;

where each of the one or more cushions is disposable.

20. The device of claim 19, further comprising a mirror.

* * * * *